US010610077B2

(12) United States Patent
Sedam

(10) Patent No.: US 10,610,077 B2
(45) Date of Patent: Apr. 7, 2020

(54) SURFACE MAINTENANCE MACHINE WITH A QUICK EJECT CLEANING TOOL ASSEMBLY

(71) Applicant: Tennant Company, Minneapolis, MN (US)

(72) Inventor: Kyle D. Sedam, Rogers, MN (US)

(73) Assignee: Tennant Company, Minneapolis, MN (US)

( * ) Notice: Subject to any disclaimer, the term of this patent is extended or adjusted under 35 U.S.C. 154(b) by 246 days.

(21) Appl. No.: 15/646,307

(22) Filed: Jul. 11, 2017

(65) Prior Publication Data

US 2018/0008113 A1 Jan. 11, 2018

Related U.S. Application Data

(60) Provisional application No. 62/360,656, filed on Jul. 11, 2016.

(51) Int. Cl.
*A47L 11/40* (2006.01)
*A47L 11/16* (2006.01)
(Continued)

(52) U.S. Cl.
CPC ..... *A47L 11/4055* (2013.01); *A47L 11/16* (2013.01); *A47L 11/24* (2013.01); *A47L 11/283* (2013.01); *A47L 11/305* (2013.01); *A47L 11/4008* (2013.01); *A47L 11/4016* (2013.01); *A47L 11/4038* (2013.01); *A47L 11/4044* (2013.01);
(Continued)

(58) Field of Classification Search
CPC ..... A47L 11/40; A47L 11/283
See application file for complete search history.

(56) References Cited

U.S. PATENT DOCUMENTS 4,866,804 A 9/1989 Masbruch et al.
5,421,053 A 6/1995 Chodak et al.
(Continued)

FOREIGN PATENT DOCUMENTS

WO 2008079944 A2 7/2008

OTHER PUBLICATIONS

International Patent Application No. PCT/US2017/041464, International Search Report and Written Opinion dated Sep. 25, 2017, 12 pages.

*Primary Examiner* — Michael D Jennings
(74) *Attorney, Agent, or Firm* — Fredrikson & Byron, P.A.

(57) ABSTRACT

A surface maintenance machine is provided having a maintenance head assembly positioned substantially within an envelope of the machine. The maintenance head assembly has at least one maintenance tool attachable thereto. The machine also includes a tool eject mechanism positioned below an upper surface of the body. The tool eject mechanism can generate a drop force sufficient to overcome the force between the maintenance tool and the maintenance head assembly. The tool eject mechanism can have an eject button extending above the upper surface of the deck. The eject button can be actuable by at least a portion of the upper surface of the body of the machine when the maintenance head assembly is raised toward the upper surface of the body of the machine beyond a transport position into a tool eject position. When actuated, the tool eject mechanism can eject the maintenance tool from the maintenance head assembly

22 Claims, 5 Drawing Sheets

(51) Int. Cl.
*A47L 11/24* (2006.01)
*A47L 11/283* (2006.01)
*A47L 11/30* (2006.01)

(52) U.S. Cl.
CPC ..... *A47L 11/4061* (2013.01); *A47L 11/4083* (2013.01)

(56) References Cited

U.S. PATENT DOCUMENTS

| | | | | |
|---|---|---|---|---|
| 8,978,190 | B2 * | 3/2015 | Leifheit et al. | |
| 2003/0126729 | A1 | 7/2003 | Pierce | |
| 2008/0078041 | A1 | 4/2008 | Mitchel et al. | |
| 2013/0005224 | A1 | 1/2013 | Leifheit et al. | |
| 2014/0237743 | A1 | 8/2014 | Baker et al. | |
| 2015/0216386 | A1 * | 8/2015 | Baker | A47L 11/283 15/49.1 |

* cited by examiner

SURFACE MAINTENANCE MACHINE WITH A QUICK EJECT CLEANING TOOL ASSEMBLY

RELATED APPLICATIONS

This application claims the benefit of U.S. Provisional Patent Application No. 62/360,656 filed Jul. 11, 2016, the entire contents of which are incorporated herein by reference.

BACKGROUND

Surface maintenance machines for relatively large floor areas, for example, of commercial, industrial, public or institutional spaces, are typically integrated with an operator-driven vehicle. These machines can be a floor scrubbing machine or a floor sweeping machine. Other machines, such as polishing, burnishing or outdoor litter collecting machines can also perform other surface maintenance operations such as cleaning (e.g., sweeping, scrubbing, etc.) or treating (e.g., polishing, burnishing, buffing, stripping and the like) on surfaces such as floors, hallways, etc. of buildings, roads, pavements, sidewalks and the like. Such machines have one or more maintenance tools for performing the above-mentioned maintenance operations. Such maintenance tools may have to be removed from the machine for replacement due to wear and/or to change the type of tool used for performing an operation.

Conventional maintenance tools are attached to a maintenance head assembly by mechanical means (e.g., spring-loaded clips) or using a magnetic coupling. To disconnect the brush, the operator may have to reach under the machine and detach mechanical couplings or step on a pedal on the maintenance head assembly to push against magnetic forces of magnetic couplings. Such operations can be time-consuming and cumbersome, especially if the maintenance tools are hard to reach from the front or rear sides of compactly packaged maintenance machines.

SUMMARY

In an aspect, the present disclosure provides a surface maintenance machine. The machine has a body supported by wheels. The machine has a maintenance head assembly positioned substantially within an envelope of the machine. The maintenance head assembly has at least one maintenance tool magnetically attachable thereto by one or more magnetic materials positioned on the maintenance tool and/or the maintenance head assembly. The magnetic materials generate a mutually attractive force to couple to the maintenance tool to the maintenance head assembly. The machine also includes a tool eject mechanism positioned below an upper surface of the body. The tool eject mechanism can generate a drop force sufficient to overcome the mutually attractive force between the maintenance tool and the maintenance head assembly.

In a further aspect, the maintenance head assembly can be raised toward an upper surface of the body to a transport position, and lowered toward a surface on which the machine is positioned, to an operating position. The tool eject mechanism can be actuable when the maintenance head assembly is further raised toward the upper surface beyond the transport position into a tool eject position, such that when actuated, the tool eject mechanism can eject the maintenance tool from the maintenance head assembly.

In a still further aspect, the maintenance head assembly includes a deck. The maintenance tool can be removably connectable to the deck. The tool eject mechanism can have an eject button extending above the upper surface of the deck. The eject button can be actuable by at least a portion of the upper surface of the body of the machine when the maintenance head assembly is raised toward the upper surface of the body of the machine, such that when actuated, the eject button generates a drop force to remove the maintenance tool from the deck.

The details of one or more examples are set forth in the accompanying drawings and the description below. Other features, objects, and advantages will be apparent from the description and drawings, and from the claims.

DETAILED DESCRIPTION

Figure 1:
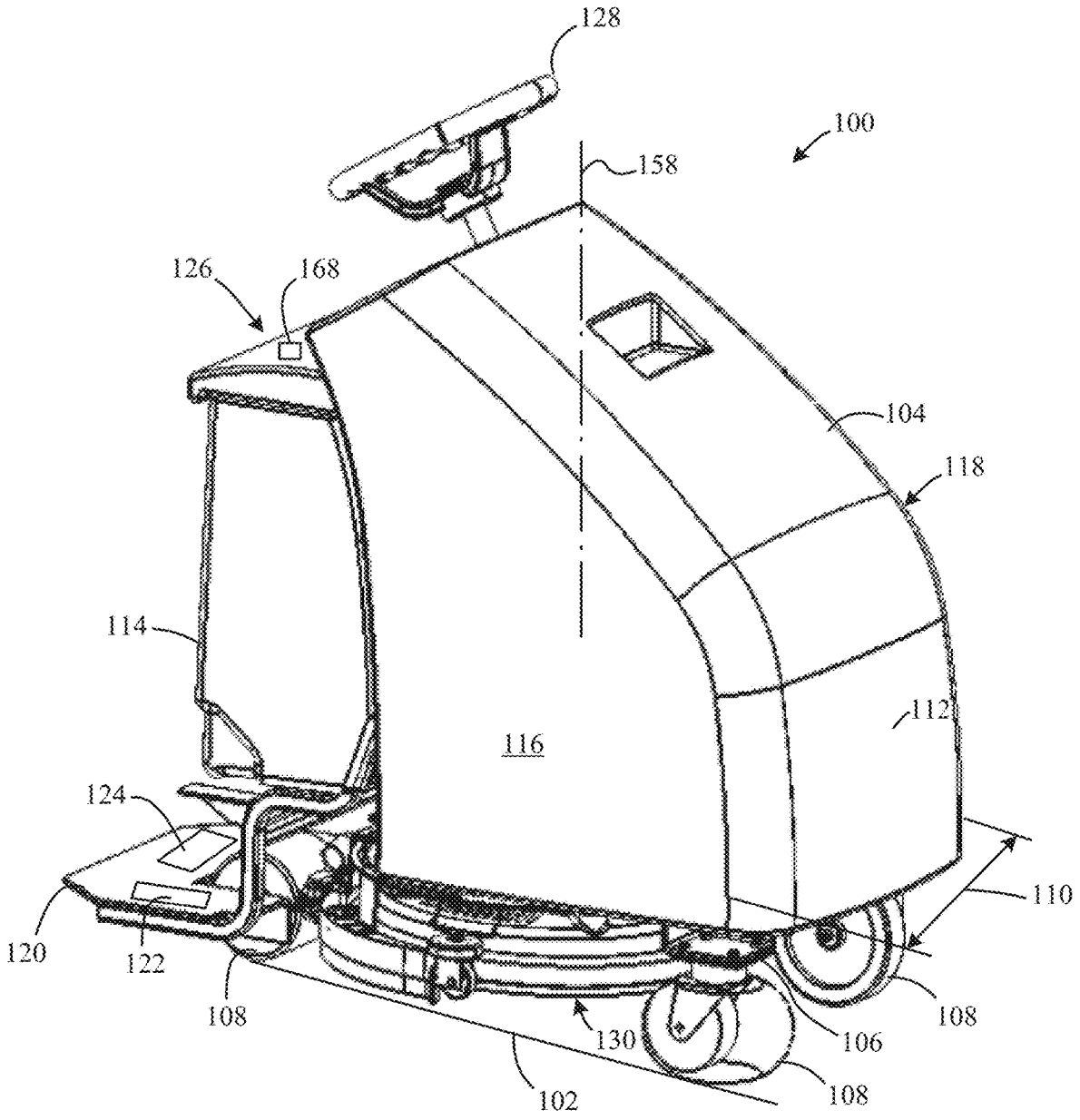
FIG. 1 is a perspective view of a surface maintenance machine according to an embodiment.

FIG. 1 is a perspective view of an exemplary surface maintenance machine 100. In the illustrated embodiment shown in FIG. 1, the surface maintenance machine 100 is a ride-on machine 100. The surface maintenance machine 100 can perform maintenance tasks such as sweeping, scrubbing, polishing (burnishing) a floor surface 102. The term floor surface 102 used herein should be understood to mean interior floor surface in buildings, garage or shop floors, as well as exterior floor surfaces such as sidewalk, pavement, road surface, and the like. Embodiments of the surface maintenance machine 100 include components that are supported on a mobile body 104. As best seen in FIG. 1, the mobile body 104 comprises a frame 106 supported on wheels 108 for travel over the surface 102, on which a surface maintenance operation is to be performed. Such an exemplary surface maintenance machine is described in the commonly-assigned application U.S. 2017/0164804 A1, titled "Surface Maintenance Machine," the entire contents of which are hereby incorporated by reference.

The surface maintenance machine 100 can be powered by an on-board power source such as one or more batteries or an internal combustion engine (not shown). The power source can be proximate the front of the surface maintenance machine 100, or it may instead be located elsewhere, such as within the interior of the surface maintenance machine 100, supported within the frame 106, and/or proximate the rear of the surface maintenance machine 100. Alternatively, the surface maintenance machine 100 can be powered by an external electrical source (e.g., a power generator) via an electrical outlet or a fuel cell. The interior of the surface maintenance machine 100 can include electrical connections (not shown) for transmission and control of various components.

Continuing with FIG. 1, the surface maintenance machine 100 according to some embodiments can be of a compact design so as to be operated in tight confines (e.g., interior hallways). Accordingly, the machine can have an overall width 110 of less than about three feet. For example, the machine 100 can have an overall width 110 of less than about 28 inches. As used herein, the term "width" refers to the distance between lateral surfaces 116, 118 (e.g., perpendicular to the longitudinal centerline and/or the transverse centerline 158) of the machine 100. The lateral confines of the machine 100 in such cases are within about 28 inches. In such cases, the machine 100 has a maintenance path corresponding to an envelope of the surface in contact with the maintenance head assembly 130 during a surface maintenance operation. The envelope as used herein can be the area defined (e.g., bound) by the front surface 112, back surface 114 and two lateral surfaces 116 and 118 of the machine 100. The maintenance path can have a width (e.g., distance between lateral surfaces 116 and 118) of between about 20 inches and about 24 inches. Such machines 100 are sometimes referred to as "micro-riders" because of their compact sizes. While an exemplary micro-rider machine is illustrated, the embodiments disclosed herein can apply similarly to machines of any sizes and configuration.

In use, an operator may ride the machine 100 in a standing position and stand on an operator platform 120. The operator platform 120 can optionally include one or more foot pedals 122, 124 for engaging with maintenance tools 136 extending from below the machine 100, as will be described further below. Continuing with the illustrated embodiment of FIG. 1, advantageously, the machine 100 includes an operator console 126 provided on the machine body 104. The operator console 126 can include controls for steering, propelling, and controlling various operations of the machine 100. For instance, the operator console 126 can include a steering control such as a steering wheel 128 such that an operator standing on the operating platform can grasp and turn the steering wheel 128 to turn the machine 100. Further, the operator console 126 can include speed controls (e.g., such as a knob, not shown) that can control the speed of the machine 100 without having to remove the operator's hands from the steering wheel 128. As is apparent from FIG. 1, the operator console 126 can be approximately at the waist-level of an adult operator standing on the operating platform. Such embodiments allow a compact vehicle design while providing easy to use controls to control the operation of the machine 100.

Figure 2:
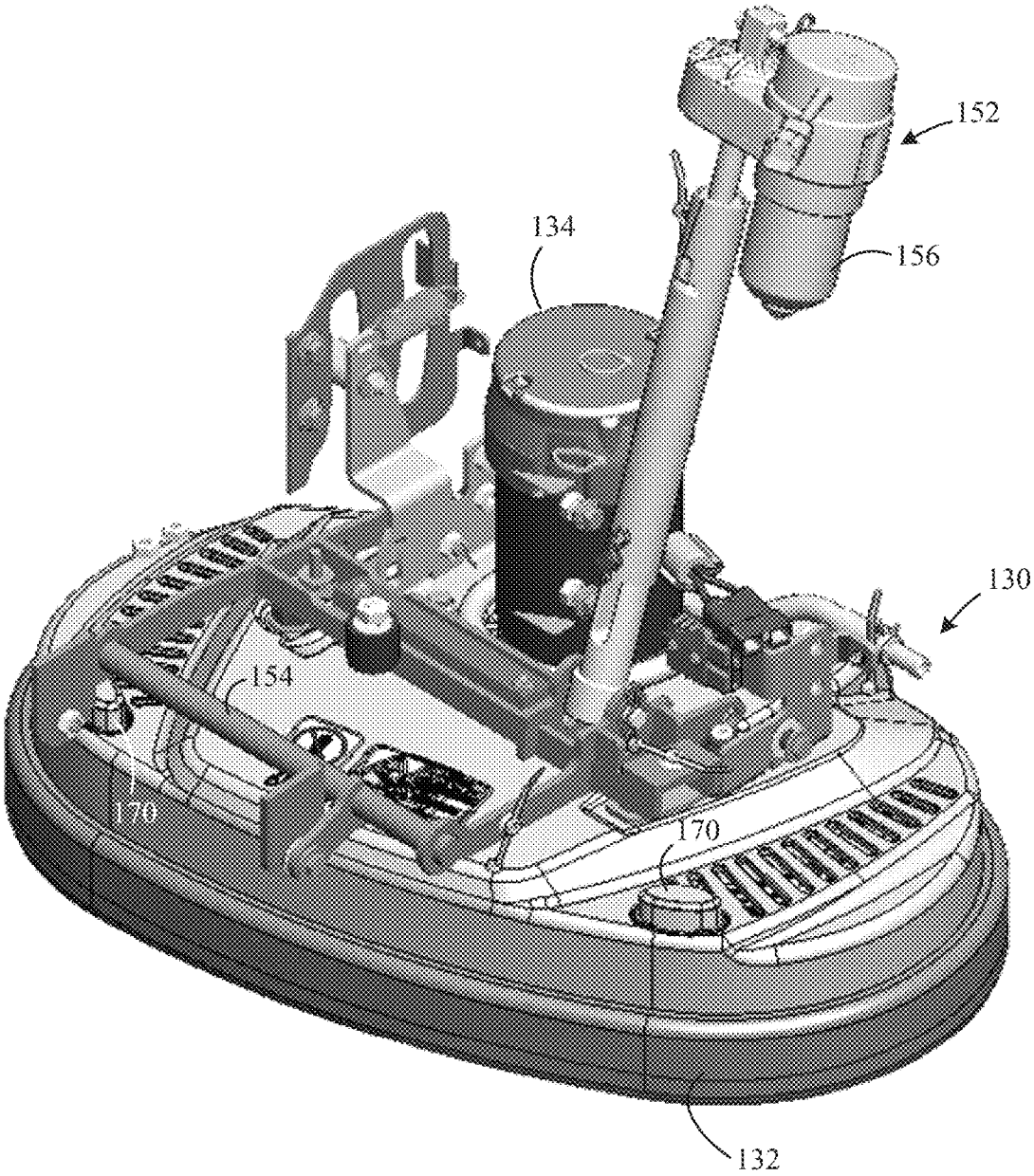
FIG. 2 is a perspective view of a maintenance head assembly of the present disclosure according to an embodiment.

Referring now to FIG. 2, which illustrates a portion of the machine 100 shown in FIG. 1, the surface maintenance machine 100 includes a maintenance head assembly 130. The maintenance head assembly 130 houses one or more maintenance tools 136 such as scrub brushes, sweeping brushes, and polishing, stripping or burnishing pads, and tools for extracting (e.g., dry or wet vacuum tools). For example, the maintenance head is a cleaning head comprising one or more cleaning tools (e.g., sweeping or scrubbing brushes). Alternatively, the maintenance head is a treatment head comprising one or more treatment tools (e.g., polishing, stripping or buffing pads). Many different types of maintenance tools 136 are used to perform one or more maintenance operations on the surface 102. The maintenance operation can be a dry operation or a wet operation. Such maintenance tools 136 include sweeping, scrubbing brushes, wet scrubbing pads, polishing/burnishing and/or buffing pads. Additionally, one or more side brushes for performing sweeping, dry or wet vacuuming, extracting, scrubbing or other operations can be provided. Further, the machine 100 can be a walk-behind or a tow-behind machine. Embodiments of the present disclosure and the maintenance head assembly 130 discussed herein can be used for any such machine and the exemplary machine 100 shown in FIG. 1 should not be construed as limiting.

Figure 3:
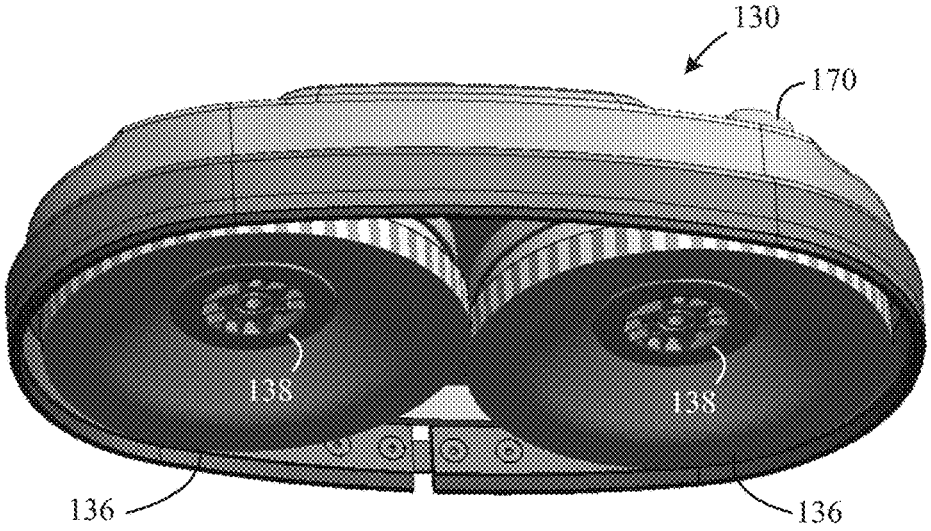
FIG. 3 is a bottom perspective view of the maintenance head assembly of FIG. 2 with a pair of maintenance tools attached thereto.
Figure 4:
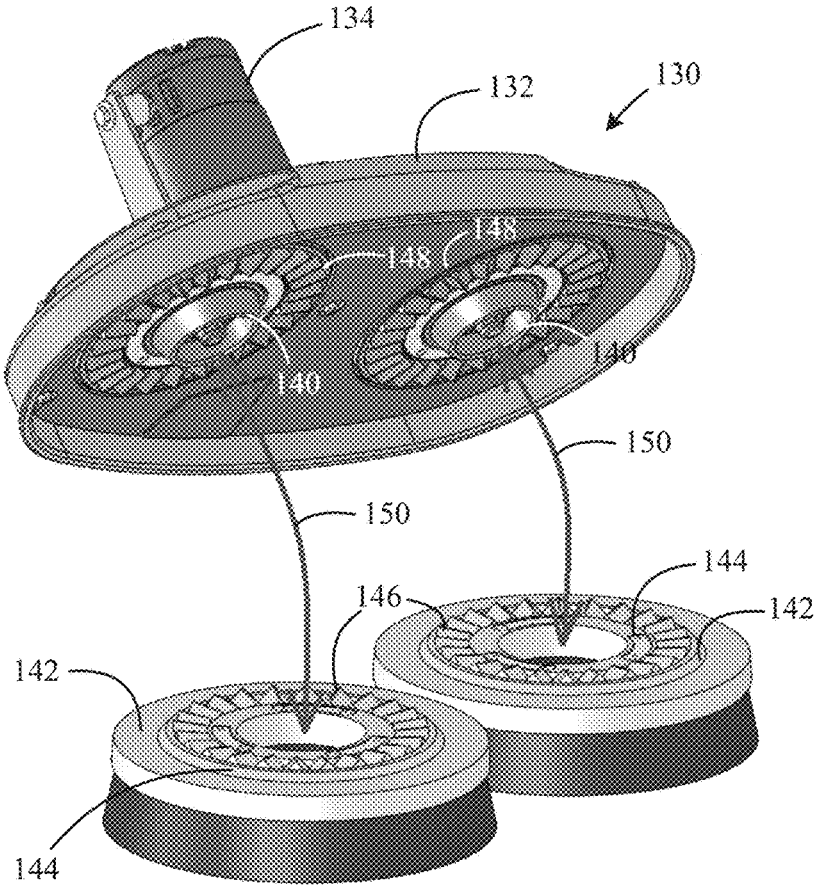
FIG. 4 is a perspective view of the maintenance head assembly of FIG. 2 with the maintenance tools removed therefrom.

Referring again to FIG. 2, the maintenance head assembly 130 comprises a deck 132 that houses one or more maintenance tools 136 (best seen in FIG. 3). The maintenance tools 136 can be coupled to the deck 132, and to a motive source 134 that can impart rotational motion to the maintenance tools 136. FIGS. 3-4 illustrate an exemplary connection between the maintenance head assembly 130 and one or more maintenance tools 136. FIG. 3 is a bottom perspective view of the maintenance head assembly 130 of FIG. 2, shown with the maintenance tools 136 coupled thereto, by way of a tool connector assembly 138 while FIG. 4 illustrates the maintenance head assembly 130 when the maintenance tools 136 are ejected therefrom. In the illustrated embodiment, the maintenance head assembly 130 includes a pair of disc-shaped scrub brushes, although, as discussed above, any maintenance tool 136 such as a brush or a pad for performing a variety of surface maintenance operations are contemplated within the scope of the present disclosure.

Referring back to FIG. 2, the maintenance tool 136 can be movable (e.g., axially movable and/or rotatable) relative to the remainder of the maintenance head assembly 130 (such as the deck 132), for instance, by a motive source 134 (e.g., a motor) that can be coupled to the maintenance tool 136 (e.g., using belts, or other motive force transmission systems, not shown) that apply torque and thereby impart a rotational motion on to the maintenance tools 136. The tool connector assembly 138 comprises a hub 140 (best seen in FIGS. 3 and 4) that can be rotationally (e.g., circumferentially and/or axially) aligned with a tool driver 142 attached to the maintenance tool 136. The hub 140 can be operatively coupled to the motive source 134 such that when the maintenance tool 136 is connected to the hub 140, rotational motion is transmitted from the motive source 134 to the maintenance tool 136. The tool driver 142 can have a connection interface 144 that can facilitate axially and rotationally aligning the maintenance tool 136 to the hub 140 (e.g., by way of complementary mechanical or magnetic connections, such as aligning teeth 146, 148 on the tool driver 142 and hub 140 respectively), and in turn align the maintenance tool 136 to the maintenance head assembly 130, as described in the commonly-assigned application U.S. 20140237743 A1, the entire contents of which is hereby incorporated by reference.

With continued reference to FIGS. 3 and 4, the maintenance tool 136 can be removably connectable to the maintenance head assembly 130. In an exemplary embodiment, the maintenance tool 136 is magnetically connected to the maintenance head assembly 130. In such cases, the magnetic connection is accomplished by way of a magnetic coupling 150 comprising one or more ferromagnets and/or an electromagnetic coupling positioned on either the maintenance head assembly 130, or the maintenance tool 136, or both. The magnetic coupling 150 generates a mutually attractive force between the hub 140 and the tool driver 142 so as to couple the maintenance tool 136 to the deck 132. Such an exemplary magnetic coupling is described in U.S. Publication No. 2014/0237743 A1, the disclosure of which is hereby incorporated by reference. Of course, other connections (mechanical coupling) between the maintenance tool 136 and the maintenance head assembly 130 are contemplated within the scope of the present disclosure.

In some embodiments, the interior of the surface maintenance machine 100 can include a vacuum system (not shown) for removal of debris from the surface 102. In such embodiments, the interior can include a fluid source tank (not shown) and a fluid recovery tank (not shown). The fluid source tank can include a fluid source such as a cleaner or sanitizing fluid that can be applied to the floor surface 102 during treating operations. The fluid recovery tank holds recovered fluid source that has been applied to the surface 102 and soiled. The interior of the surface maintenance machine 100 can include passageways (not shown) for passage of debris and dirty liquid. In some such cases, the vacuum system can be fluidly coupled to the recovery tank for drawing dirt, debris or soiled liquid from the surface 102. The vacuum system may comprise a vacuum-assisted squeegee mounted to extend from a lower rearward portion of machine 100. Fluid, for example, clean liquid, which may be mixed with a detergent, can be dispensed from the scrubbing fluid tank to the floor beneath machine 100, in proximity to the scrubbing brushes, and soiled scrubbing fluid is drawn by the squeegee centrally, after which it is suctioned via a recovery hose into the recovery tank.

The machine can include a controller (not shown) operatively coupled to the operator console 126, foot pedals 122 and various machine components such as power source, steering and propelling systems, lift mechanism and suspension 152, water and/or cleaning solution supply system, vacuum system, and maintenance head assembly 130. Advantageously, such embodiments permit the operator to operate the machine by manipulating operator consoles and/or foot pedals 122. Machine 100 can also include a feedback control system to operate these and other elements of machine 100, according to apparatus and methods which are known to those skilled in the art.

In alternative embodiments, the surface maintenance machines 100 may be combination sweeper and scrubber machines 100. In such embodiments, in addition to the elements describe above, the machines 100 may either be an air sweeper-scrubber or a mechanical sweeper-scrubber. Such machines 100 can also include sweeping brushes (e.g., rotary broom) extending toward a surface 102 (e.g., from the underside of the machine 100), with the sweeping brushes designed to direct dirt and debris into a hopper. In the cases of an air sweeper-scrubber, the machine 100 can also include a vacuum system for suctioning dirt and debris from the surface 102. In still other embodiments, the machine 100 may be a sweeper. In such embodiments, the machine 100 may include the elements as described above for a sweeper and scrubber machine 100, but would not include the scrubbing elements such as scrubbers, squeegees and fluid storage tanks (for detergent, recovered fluid and clean liquid).

Referring back to FIG. 2, the maintenance head assembly 130 can be attached to the body 104 (e.g., a frame member 106) of the surface maintenance machine 100 such that the maintenance head assembly 130 can be lowered to an operating position (so as to be in contact with the floor surface 102) and raised to a traveling position when the machine 100 is not performing a maintenance operation. The maintenance head assembly 130 is connected to the surface maintenance machine 100 using any known mechanism, such as a lift mechanism and suspension 152, as illustrated in U.S. Pat. No. 9,124,544, assigned to the assignee of the present application, Tennant Company of Minneapolis, Minn., the disclosure of which is hereby incorporated by reference.

With continued reference to FIG. 2, the lift mechanism and suspension 152 allows the maintenance head assembly 130 to be raised and lowered and allows the maintenance tools 136 to conform to undulations in the floor. The deck 132 of the maintenance head assembly 130 is attached to the frame 106 of the machine 100 (not shown in FIG. 2) by a lift mechanism and suspension 152 assembly that includes a main lift arm 154, a linear actuator 156, and associated coupling structures. Coupling structures include brackets, springs, control arms, and the like for providing controlled pivoting of the linear actuator 156 relative to the deck 132 so as to keep the maintenance tools 136 in contact with the floor surface 102 (e.g., when traveling over uneven floor surfaces) when performing a maintenance operation, and be raised to the traveling position when the machine 100 is not performing a maintenance operation.

Components of the lift mechanism and suspension 152 can be operatively coupled to the operator console 126 and/or foot pedals 122 on the operator platform 120. For example, the foot pedals 122 can be mechanically coupled to coupling structures of the lift mechanism and suspension 152. Additionally, the foot pedals 122 can be electrically coupled to a controller in communication with the linear actuator 156 such that when the foot pedals 122 are pressed by the operator's feet, the controller communicates with the linear actuator 156 to raise or lower the maintenance head assembly 130 to move it between the operating position and the transport position.

Referring back to FIG. 1, the maintenance tool is positioned generally centered (e.g., equidistant from the front and back surfaces) on the transverse centerline 158 of the machine, so as to be efficiently packaged. This may be the case when the machine 100 is a "micro-rider" having compact widths and depths (e.g., less than about 3 feet wide and about 3 feet deep). In such cases, the maintenance tool may be substantially contained within the envelope defined by the body of the machine 100, and may not be readily accessible with a user's hands or feet unlike conventional surface maintenance machines 100 with maintenance tools positioned to the front of the transverse centerline 158 of the machine 100. For instance, the maintenance tool may be contained entirely within the envelope defined by the body (e.g., frame 106) of the machine 100, and can be covered (e.g., surrounded) entirely by the body of the machine 100. Further, even if the maintenance tool were generally accessible, manually detaching the maintenance tool may be cumbersome and may require the operator to apply a force that exceeds the clamping force (e.g., magnetic attraction force) between portions of the maintenance head assembly 130 (e.g., hub 140) and the maintenance tools 136. Accordingly, some such embodiments of the present disclosure provide a touch-free quick eject mechanism for ejecting the maintenance tool 136. While the above example is provided for illustration, it should be understood that embodiments of the present disclosure and the tool eject mechanism 160 discussed herein can be used for any known surface maintenance machines and the exemplary machine 100 shown in FIG. 1 should not be construed as limiting.

Figure 5:
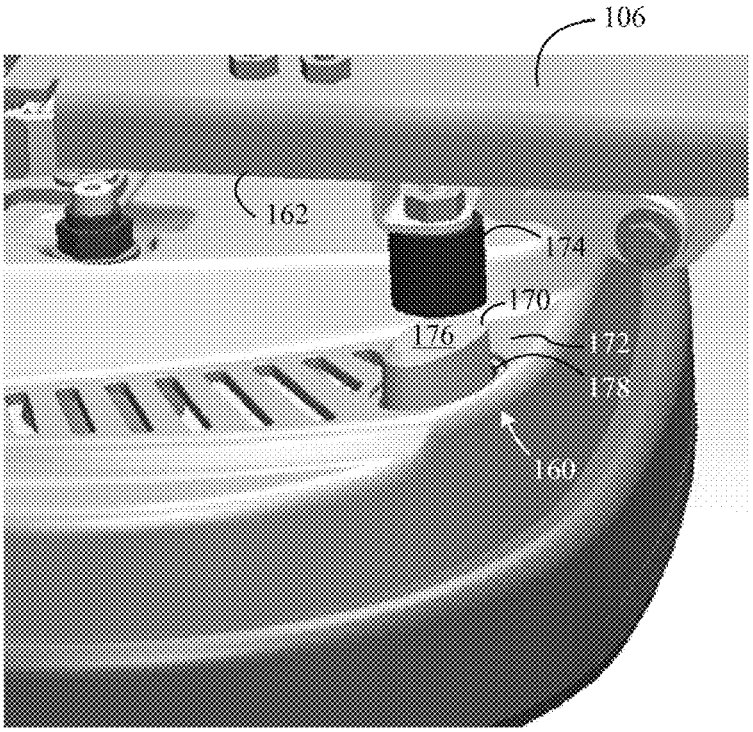
FIG. 5 is a close-up perspective view of the maintenance head assembly of FIG. 2 to illustrate a tool eject mechanism in the unactuated state.
Figure 6:
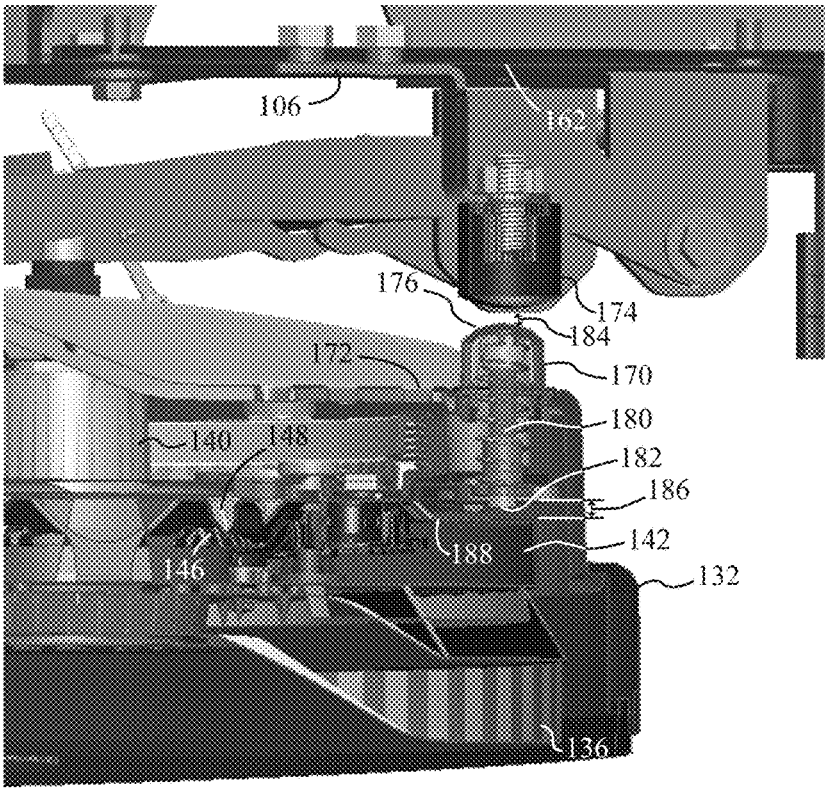
FIG. 6 is a cross-sectional front view of the tool eject mechanism in the unactuated state.
Figure 7:
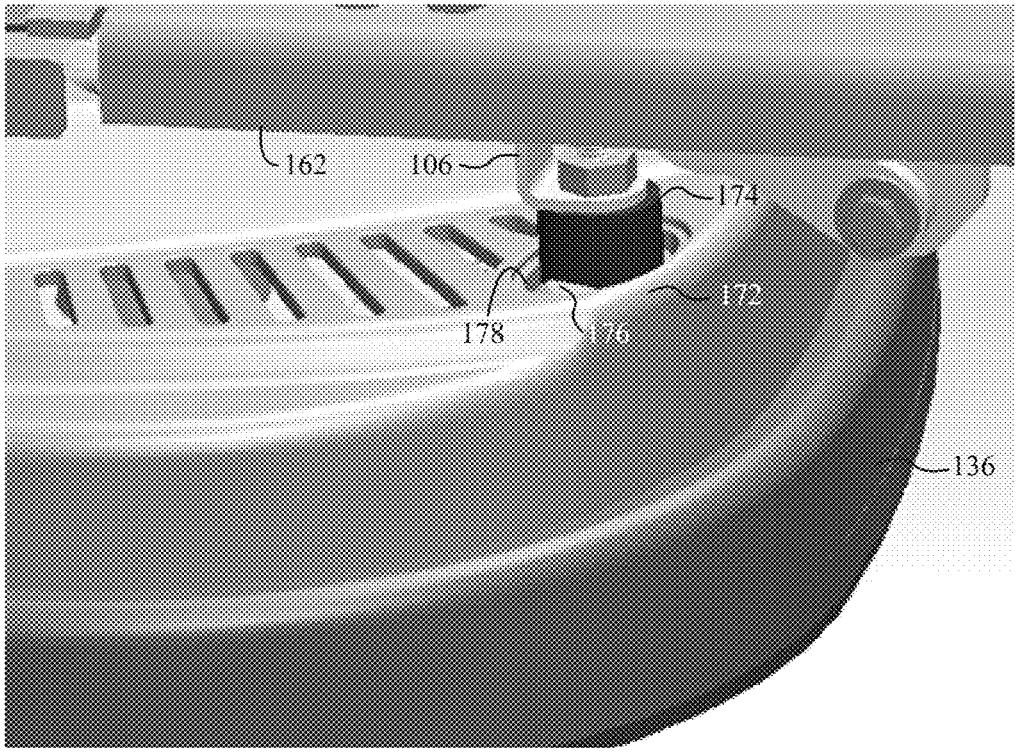
FIG. 7 is a close-up perspective view of the maintenance head assembly of FIG. 2 to illustrate a tool eject mechanism in the actuated state.
Figure 8:
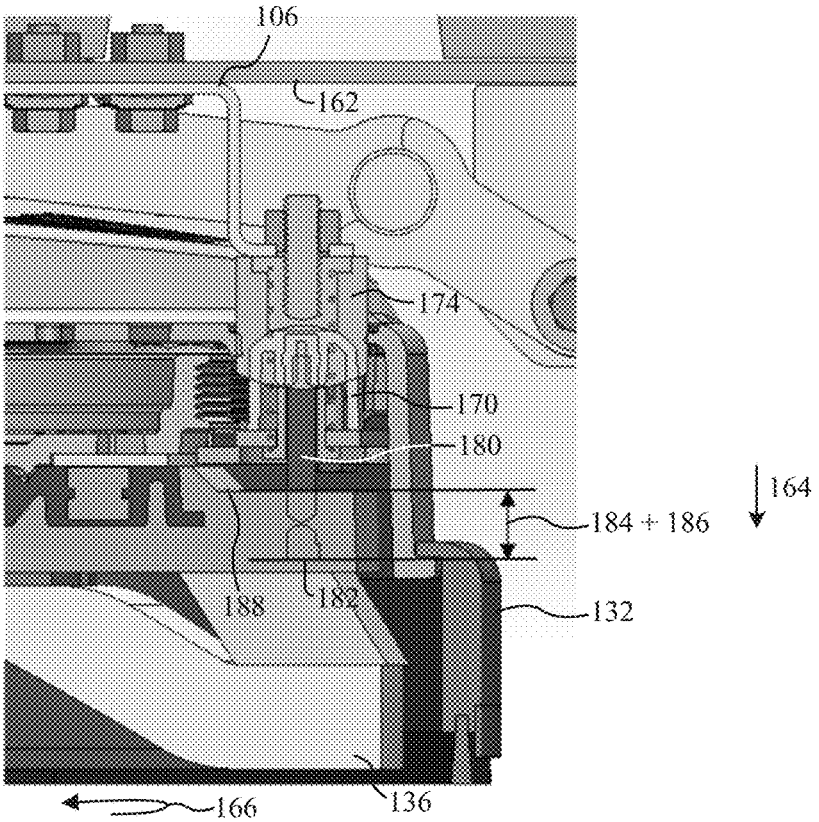
FIG. 8 is a cross-sectional front view of the tool eject mechanism in the actuated state.

FIGS. 5-8 illustrate an enlarged view of a portion of the maintenance head assembly 130 shown in FIG. 2. Embodiments illustrated in FIGS. 5-8 provide a tool eject mechanism 160, examples of which permit quickly disconnecting the maintenance tool 136 in a touch-free manner. FIGS. 5 and 6 illustrate respectively, a close-up perspective view and a sectional front view of the maintenance head assembly 130 when the tool eject mechanism 160 has not been actuated. In this view, the maintenance head assembly 130 is raised to a vertical distance above the floor surface 102 that corresponds to the transport position. FIGS. 7 and 8 illustrate a close-up perspective view and a sectional front view of the maintenance head assembly 130 when the tool eject mechanism 160 is actuated. In this position, the maintenance head assembly 130 is raised to a vertical distance above the floor surface 102 that is further above its vertical distance (from the floor surface 102) in the transport position. Accordingly, the maintenance head assembly 130 according to some embodiments of the present disclosure can be raised (e.g., by the lift mechanism and suspension 152) to a tool eject position, so that the maintenance head is further away from the floor surface 102 in the tool eject position than in the transport position. The lift mechanism and suspension 152 of the present disclosure (e.g., as illustrated in FIG. 2) can therefore advantageously move the maintenance head assembly 130 between one of the three positions: operating position, transport position and tool eject position. As seen in FIG. 1, it that the maintenance head assembly 130 can be closest to the floor surface 102 in the operating position, than in the transport position or in the tool eject position. In the operating position, the maintenance tools 136 may contact the floor surface.

Referring again to FIGS. 5 and 6, the tool eject mechanism 160 according to some exemplary embodiments are positioned below an upper surface 162 of the machine's body 104. For instance, the upper surface 162 can be a generally planar surface of the machine 100 frame 106 (e.g., vehicle chassis). Alternatively, the upper surface 162 can be a surface (planar or non-planar) of other components of the machine body, such as solution tanks, body panels and the like. The tool eject mechanism 160 according to some exemplary embodiments of the present disclosure can be actuable, as will be described further below, when the maintenance head assembly 130 is further raised toward the upper surface 162 into the tool eject position (e.g., to be further above the vertical distance in the transport position), such that when actuated, the tool eject mechanism 160 can eject the maintenance tool 136 from the maintenance head assembly 130.

With continued reference to FIGS. 5 and 6, the tool eject mechanism 160 according to certain embodiments generates a drop force 164 oriented generally in a downward direction (e.g., as shown by arrow 164) can eject the maintenance tool 136 from the maintenance head assembly 130. Further, the tool eject mechanism 160 according to certain embodiments can generate a shear force 166 (e.g., as shown by arrow 166) to further facilitate ejection of the maintenance tool 136 from the maintenance head assembly 130, as will be described further below. Advantageously, the tool eject mechanism 160 is actuable in a touch-free manner without having the operator directly contact the maintenance head assembly 130 or the maintenance tool 136. Such embodiments improve ease of ejection of the maintenance tool 136, especially when the maintenance head assembly 130 is less accessible, such as when the maintenance head assembly 130 is centrally positioned about a transverse centerline 158 in micro-rider type surface maintenance machines 100. However, it should be noted that the tool eject mechanism 160 according to the present disclosure can be used with any maintenance head assembly 130 including those that are positioned to the front of a transverse centerline 158, laterally to one side of a longitudinal centerline of the machine 100, to the rear of the transverse centerline 158 and any other location on the machine 100, and the examples illustrated herein should not be construed as limiting.

With continued reference to FIG. 5 and referring back to FIG. 1, the tool eject mechanism 160 can be operatively coupled the operator console 126 or the operator platform 120 such that the tool eject mechanism 160 can be actuated by an operator by manipulating one or more controls on the operator console 126 or by pressing pedals (e.g., 122, 124) on the operator platform 120. For instance, the operator console 126 can include at least one eject control 168 on the operator console 126 that is actuable so as to further raise the maintenance head assembly 130 from the transport position to the tool eject position. The eject control 168, for instance can be a button on the operator console 126 that can be pressed by the operator which will initiate the tool eject sequence (e.g., by closing an electrical switch and signaling the controller, and in turn other machine components), as described below. The eject control 168 can be actuated by applying a force (e.g., pressure over the area of the eject control 168) thereon, which can be generally lower than the drop force 164 generated by the tool eject mechanism 160. Accordingly, the tool eject mechanism 160 is less cumbersome for an operator to use relative to conventional tool removal mechanisms known in the art whereby the requisite force to eject the tool is typically supplied manually by the operator.

As described elsewhere herein, the tool eject mechanism 160 can generate a drop force 164 that facilitates ejecting the maintenance tool 136 from the maintenance head assembly 130. Further, as described elsewhere herein, the maintenance tool 136 is magnetically coupled to the maintenance head assembly 130 in some embodiments. Accordingly in such embodiments, the drop force 164 is of a magnitude sufficient to overcome the magnetic attraction force between the maintenance tool 136 and the maintenance head assembly 130. In an exemplary embodiment, the drop force 164 can be at least equal in magnitude to the magnetic attraction force (e.g., between the maintenance tool 136 and the maintenance head assembly 130), but act in a direction opposite thereto. In other embodiments where a shear force 166 is additionally acts on the maintenance tool 136 (e.g., when rotated by the motive source 134), such a shear force 166 can assist with tool ejection. Accordingly, in such cases, the drop force 164 may not necessarily be equal to and/or greater than the magnetic attraction force between the maintenance tool 136 and the maintenance head assembly 130.

As indicated above, and with reference to FIGS. 2 and 5, a motive source 134 is operatively coupled (e.g., via hub 140 and tool driver 142, best seen in FIGS. 6 and 8) to the maintenance tool 136. The motive source 134 generates a torque that is transmitted to the maintenance tool 136 to impart a first rotational motion on to the maintenance tool 136 when the maintenance head assembly 130 is in the operating position. The first rotational motion facilitating the maintenance tool 136 to perform a surface maintenance operation. Further, the motive source 134 imparts a second rotational motion on to the maintenance tool 136 when the maintenance head assembly 130 is in the tool eject position. The second rotational motion generates the shear force 166 to assist the drop force 164 in ejecting the maintenance tool 136 from the maintenance head assembly 130. The first rotational motion can have a first rotational speed and a first rotational direction. The second rotational motion can have a second rotational speed and a second rotational direction. In certain embodiments, the second rotational speed can be generally lower than the first rotational speed. Alternatively, the second rotational speed can be generally equal to or generally greater than the first rotational speed. Similarly, the first and second rotational directions can be generally the same (e.g., both generally clockwise and both generally counterclockwise when viewed from above the front of the machine 100), or have one of the first and second rotational directions be generally clockwise, while the other of the first and second rotational directions be generally counterclockwise (e.g., whereby the first and second rotational directions are generally opposite to each other).

In the embodiments illustrated herein, the motive source 134 can be operatively coupled to the machine 100 controller, which in turn is operatively coupled to the operator console 126, so that when the operator actuates the eject control 168, the maintenance head assembly 130 is raised to the tool eject position (e.g., using the lift mechanism and suspension 152), and the eject sequence is initiated, which may involve applying a drop force 164 using the tool eject mechanism 160 (described below), and applying torque (e.g., using the motive source 134) to generate the second rotational motion to provide a shear force 166. In certain exemplary embodiments, the shear force 166 can act in a plane that is generally perpendicular to the drop force 164. For instance, in the illustrated embodiment, the drop force 164 is generally vertical (e.g., downward), whereas the shear force 166 can be a rotational torque that acts along a generally horizontal plane that is perpendicular to the maintenance tools 136.

Referring now to FIGS. 5 and 6, the tool eject mechanism 160 comprises one or more eject members positioned on the maintenance head assembly 130 and/or the body 104 of the machine 100 that are co-operatively actuable when the maintenance head assembly 130 is moved from its transport position to the tool eject position. For instance, in the illustrated embodiment, the eject members include an eject button 170 extending above a generally planar upper surface 172 of the deck 132. The eject button 170 can be actuated by at least a portion of the generally planar upper surface 162 of the body 104 of the machine 100 when the maintenance head assembly 130 is raised from the transport position and into the tool eject position. When actuated, the eject button 170 generates a drop force 164 (e.g., greater than or equal to the mutually attractive magnetic force) to eject the maintenance tool 136 from the deck 132.

Optionally, the generally planar upper surface 162 of the body 104 of the machine 100 comprises a bumper 174 positioned thereon and extending therebelow toward the maintenance head assembly 130. As seen in FIGS. 5 and 6, the eject button 170 is axially aligned with the bumper 174, such that when the maintenance head assembly 130 is raised upward from the transport position (shown in FIGS. 5 and 6) and into the tool eject position (shown in FIGS. 7 and 8), the eject button 170 is pressed by the bumper 174. The eject button 170 can have a generally resilient top surface 176, which, when pushed by the bumper 174 can squeeze into an aperture 178 provided on the deck 132.

With continued reference to FIGS. 6 and 8, the eject button 170 comprises a spring-loaded pin 180 spring biased to remain in an unactuated position shown in FIG. 6. For instance, when the maintenance head assembly 130 is in the transport or operating position, the spring-loaded pin 180 is spring biased to remain in the unactuated position illustrated in FIG. 6, whereas when the bumper 174 abuts against the top surface 176 of the eject button 170 (e.g., as shown in FIGS. 7 and 8), the spring-loaded pin 180 is pushed toward the maintenance tool 136 extending below the pin. Once the maintenance tool 136 is ejected, the maintenance head assembly 130 is lowered into the transport position (from the tool eject position), in turn resulting the eject button 170 being pushed to its unactuated state shown in FIG. 6 because of the spring-biasing of the spring-loaded pin 180.

As seen in FIG. 6, in the unactuated state, a bottom end 182 of the spring-loaded pin 180 is positioned above the tool driver 142. A first gap 184 exists between the bumper 174 and the top surface 176 of the eject button 170, and a second gap 186 exists between the bottom end 182 of the spring-loaded pin 180 and the top surface 188 of the tool driver 142. As is apparent to one skilled in the art, the distance traveled by the maintenance head assembly 130 between the transport position and the tool eject position is equal to the first gap 184. As the bumper 174 presses against the top surface 176 of the eject button 170 to generate a drop force 164, the spring-loaded pin 180 travels a distance that equals the second gap 186 to transmit the drop force 164 on to the top surface 188 of the tool driver 142. The drop force 164, and optionally the shear force 166 overcome the mutually attractive magnetic force, thereby ejecting the maintenance tool 136 from the deck 132, and completing the eject sequence. At the end of the eject sequence, the controller may send a signal to the lift mechanism and suspension 152 to lower the maintenance head assembly 130 from the tool eject position, back to the transport position.

While the above embodiment involves the cooperative actuation of the eject button 170 by the bumper 174, the above-mentioned eject operation can be performed with just an eject button 170, or just a bumper 174 (and/or any other structural elements on the body of the machine). For instance, rather than abutting against the bumper 174, the eject button 170 can abut against a portion of the frame 106 of the machine 100, which would provide the same effect as abutting against the bumper 174. In such cases, as is apparent to one skilled in the art, the eject button 170 extends further above the generally planar upper surface 172 of the deck 132 than is illustrated in FIG. 6. Alternatively, the above-mentioned eject sequence can be accomplished just with the bumper 174, and without the eject button 170. In such cases, the bumper 174 is sized to extend through the aperture 178 on the deck 132 when the maintenance head assembly 130 is raised to the tool eject position. The bumper 174 may, in such cases, push either through the spring-loaded pin 180, or directly on the tool driver 142 to generate the drop force 164 and complete the eject sequence.

Embodiments of the tool eject mechanism disclosed herein can have one or more advantages. The tool eject mechanism can facilitate touch-free tool ejection. Further, the tool eject mechanism can improve ease of removal of maintenance tools for servicing or replacement in situations where the tools are not easily accessible (e.g., in the case of compactly-designed maintenance machines), or if the operator does not want to manually reach under the machine and remove the maintenance tools. The tool eject mechanism according to some embodiments of the present disclosure can be fully-automated, and can permit tool ejection initiated by a simple push-button operation without having the operator apply manual force or pressure, thereby improving operator comfort during machine operation.

Various examples have been described. These and other examples are within the scope of the following claims.

The invention claimed is:

1. A surface maintenance machine comprising:

a body supported by wheels;

a maintenance head assembly supported by the machine and being movable between a transport position, an operating position, and a tool eject position, wherein, in the transport position, the maintenance head assembly is raised toward an upper surface of the body, in the operating position, the maintenance head assembly is lowered toward a surface on which the machine is positioned, and in the tool eject position, the maintenance head assembly is raised toward the upper surface beyond the transport position such that in the tool eject position the maintenance head assembly is further away from the surface on which the machine is positioned than in the transport position, the upper surface being vertically spaced apart from the surface on which the machine is positioned, the maintenance head assembly comprising at least one maintenance tool removably connectable to the maintenance head assembly, the maintenance tool being movable relative to the maintenance head assembly; and a tool eject mechanism positioned below the upper surface of the body, the tool eject mechanism being actuable upon the maintenance head assembly being moved into the tool eject position, such that when actuated, the tool eject mechanism ejects the maintenance tool from the maintenance head assembly.

2. The surface maintenance machine of claim 1, further comprising a lift mechanism and suspension to move the maintenance head assembly between the operating position, the transport position and the tool eject position.

3. The surface maintenance machine of claim 1, wherein the tool eject mechanism generates a drop force oriented generally in a downward direction to eject the maintenance tool from the maintenance head assembly.

4. The surface maintenance machine of claim 3, wherein the maintenance tool is rotatable relative to the maintenance head assembly, the surface maintenance machine further comprising a motive source operatively coupled to the maintenance tool, the motive source imparting:

a first rotational motion to the maintenance tool when the maintenance head assembly is in the operating position, the first rotational motion facilitating the maintenance tool to perform a surface maintenance operation; and a second rotational motion to the maintenance tool when the maintenance head assembly is in the tool eject position, the second rotational motion providing a shear force to facilitate ejecting the maintenance tool from the maintenance head assembly.

5. The surface maintenance machine of claim 4, wherein the shear force acts in plane that is generally perpendicular to the drop force.

6. The surface maintenance machine of claim 5, further comprising an operator console provided on the body, the operator console being operatively coupled to the lift mechanism and suspension, the operator console comprising one or more controls for controlling operation of the machine, at least one eject control on the operator console being actuable so as to further raise the maintenance head assembly from the transport position to the tool eject position.

7. The surface maintenance machine of claim 6, wherein the eject control is actuated by applying a force thereon, the force applied being substantially lower the drop force.

8. The surface maintenance machine of claim 7, further comprising an operator platform positioned to the rear of the machine, the operator platform providing a surface for the operator to stand thereon, the operator platform comprising one or more foot pedals operatively coupled to the lift mechanism and suspension, the foot pedals being actuable by an operator's foot to move the maintenance head assembly between the operating position and the transport position.

9. The surface maintenance machine of claim 1, wherein the tool eject mechanism comprises one or more eject members positioned on the maintenance head assembly and/or the body of the machine, the eject members being co-operatively actuable when the maintenance head assembly is moved from its transport position to the tool eject position.

10. The surface maintenance machine of claim 1, wherein the upper surface of the body is generally planar, and the eject member comprises a bumper positioned on the upper surface of the body and extending therebelow toward the maintenance head assembly, wherein, when the maintenance head assembly is further raised from the transport position to the tool eject position, the bumper pushes against the maintenance tool.

11. The surface maintenance machine of claim 10, wherein the eject member comprises an eject button positioned on a planar surface of the maintenance head assembly, wherein, when the maintenance head assembly is further raised from the transport position to the tool eject position the eject button is pressed by the bumper.

12. The surface maintenance machine of claim 11, wherein the bumper abuts the eject button in the tool eject position.

13. A surface maintenance machine comprising:

a body supported by wheels;

a maintenance head assembly supported by the machine and being movable between a transport position and an operating position, wherein, in the transport position, the maintenance head assembly is raised toward an upper surface of the body, and in the operating position, the maintenance head assembly is lowered toward a surface on which the machine is positioned, the upper surface being vertically spaced apart from the surface on which the machine is positioned, the maintenance head assembly comprising at least one maintenance tool removably connectable to the maintenance head assembly, the maintenance tool being movable relative to the maintenance head assembly; and a tool eject mechanism positioned below the upper surface of the body, the tool eject mechanism being actuable when the maintenance head assembly is further raised toward the upper surface beyond the transport position into a tool eject position, such that when actuated, the tool eject mechanism ejects the maintenance tool from the maintenance head assembly, wherein the tool eject mechanism comprises one or more eject members positioned on the maintenance head assembly and/or the body of the machine, the eject members being co-operativey actuable when the maintenance head assembly is moved from its transport position to the tool eject position, and wherein the upper surface of the body is generally planar, and the eject member comprises a bumper positioned on the upper surface of the body and extending therebelow toward the maintenance head assembly, wherein, when the maintenance head assembly is further raised from the transport position to the tool eject position, the bumper pushes against the maintenance tool.

14. The surface maintenance machine of claim 13, wherein the eject member comprises an eject button positioned on a planar surface of the maintenance head assembly, wherein, when the maintenance head assembly is further raised from the transport position to the tool eject position the eject button is pressed by the bumper.

15. The surface maintenance machine of claim 14, wherein the bumper abuts the eject button in the tool eject position.

16. A surface maintenance machine comprising:

a body supported by wheels;

a maintenance head assembly being positioned substantially within an envelope of the machine, the maintenance head assembly comprising at least one maintenance tool magnetically attachable thereto by one or more magnetic materials positioned on the maintenance tool and/or the maintenance head assembly, the magnetic materials generating a mutually attractive force to couple the maintenance tool to the maintenance head assembly, the maintenance head assembly being movable between a transport position, in which the maintenance head assembly is raised toward the body, an operating position, in which the maintenance head assembly is lowered toward a surface on which the machine is positioned, and a tool eject position, in which the maintenance head assembly is raised toward the body beyond the transport position such that in the tool eject position the maintenance head assembly is further away from the surface on which the machine is positioned than in the transport position; and a tool eject mechanism positioned below an upper surface of the body, the tool eject mechanism generating a drop force upon the maintenance head assembly being moved into the tool eject position, the drop force being sufficient to overcome the mutually attractive force between the maintenance tool and the maintenance head assembly.

17. The surface maintenance machine of claim 16, wherein the maintenance head assembly is generally contained within the envelope of the machine, the envelope of the machine being defined by a front surface, a back surface, and a pair of lateral surfaces.

18. The surface maintenance machine of claim 16, wherein the drop force is greater than or equal to the mutually attractive force between the maintenance tool and the maintenance head assembly.

19. The surface maintenance machine of claim 16, wherein the body includes an upper surface toward which the maintenance head assembly is raised, and wherein the upper surface is vertically spaced apart from the surface on which the machine is positioned.

20. The surface maintenance machine of claim 19, wherein the upper surface of the body is generally planar, and the eject member comprises a bumper positioned on the upper surface of the body and extending therebelow toward the maintenance head assembly, wherein, when the maintenance head assembly is further raised from the transport position to the tool eject position, the bumper pushes against the maintenance tool.

21. The surface maintenance machine of claim 20, wherein the eject member comprises an eject button positioned on a planar surface of the maintenance head assembly, wherein, when the maintenance head assembly is further raised from the transport position to the tool eject position the eject button is pressed by the bumper.

22. The surface maintenance machine of claim 21, wherein the bumper abuts the eject button in the tool eject position.

* * * * *